United States Patent [19]

Asper

[11] 4,160,354

[45] Jul. 10, 1979

[54] PACKING HEAD FILL SAFETY DEVICE

[75] Inventor: Wayne E. Asper, Albany, Ga.

[73] Assignee: A-T-O Inc., Willoughby, Ohio

[21] Appl. No.: 907,483

[22] Filed: May 19, 1978

[51] Int. Cl.[2] ..... B65B 57/10

[52] U.S. Cl. ..... 53/497

[58] Field of Search ..... 53/496, 497

[56] References Cited

U.S. PATENT DOCUMENTS

| | | | |
|---|---|---|---|
| 3,561,189 | 2/1971 | Raudat | 53/497 |
| 4,030,269 | 6/1977 | Mais et al. | 53/497 |

*Primary Examiner*—Travis S. McGehee

*Attorney, Agent, or Firm*—Oldham, Oldham, Hudak & Weber Co.

[57] ABSTRACT

A safety device for a case packer filling head wherein an individual pivotally positioned stop member is provided for each of the rows of articles being fed to the filling head and wherein an article moved completely into the filling head strikes a stop member to move it to an operative position but with the stop member having a normally inoperative safety position, a control bar extends transversely of the filling head and through a non-circular aperture provided in each stop member, and a stop device on the control bar for each of the stop members and sized complementary to part of the aperture provided in said stop member to be movable into such aperture when the stop member is moved to an operative position but only when all stop members are so operatively positioned, the control bar being movable transversely of the filling head for a control action on the filling head and articles positioned therein when all stop members are moved to operative positions.

6 Claims, 7 Drawing Figures

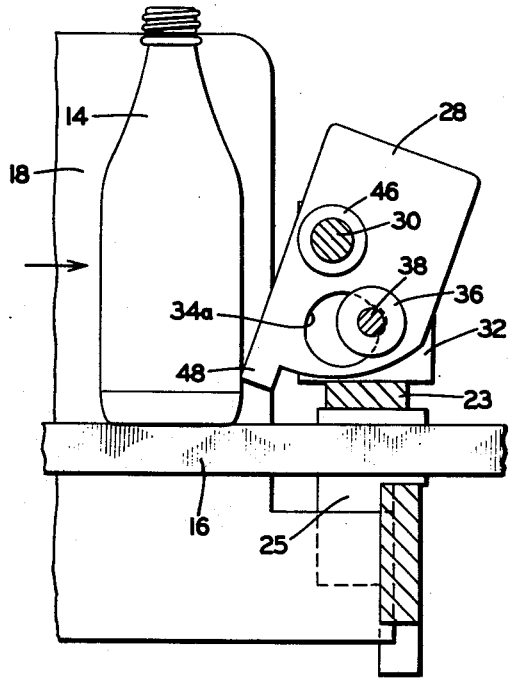

FIG. 3
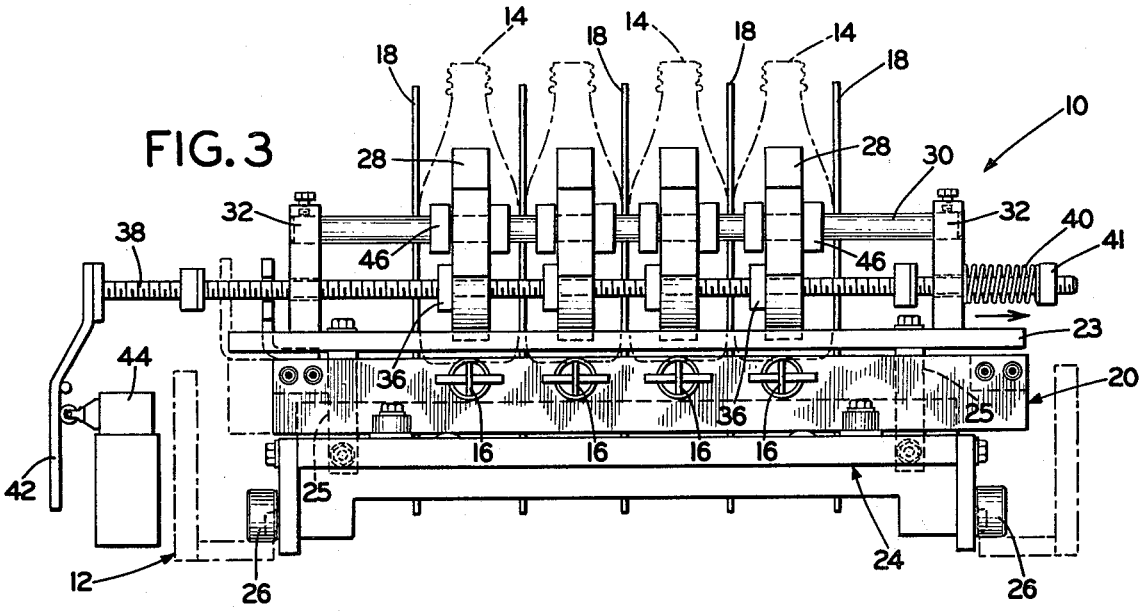
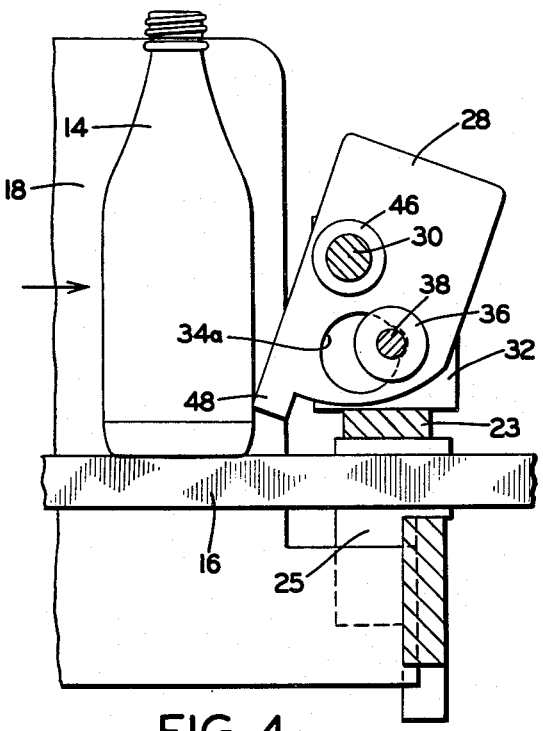
FIG. 4
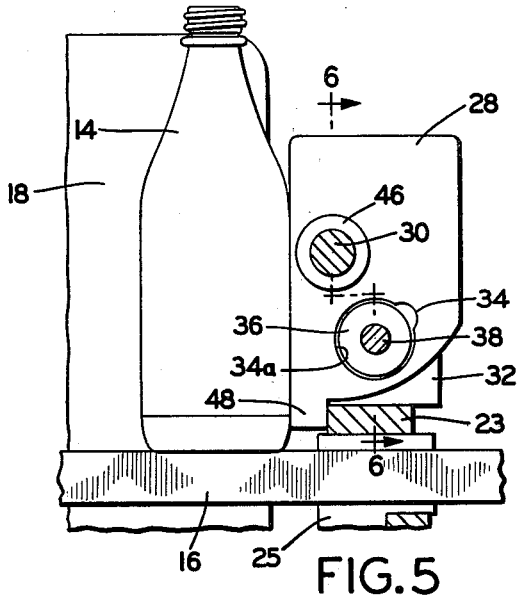
FIG. 5
FIG. 6
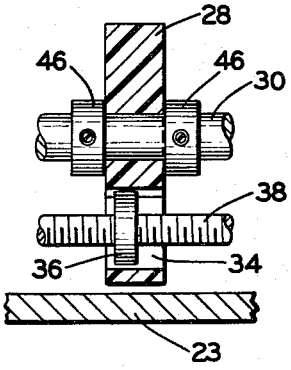
FIG. 7
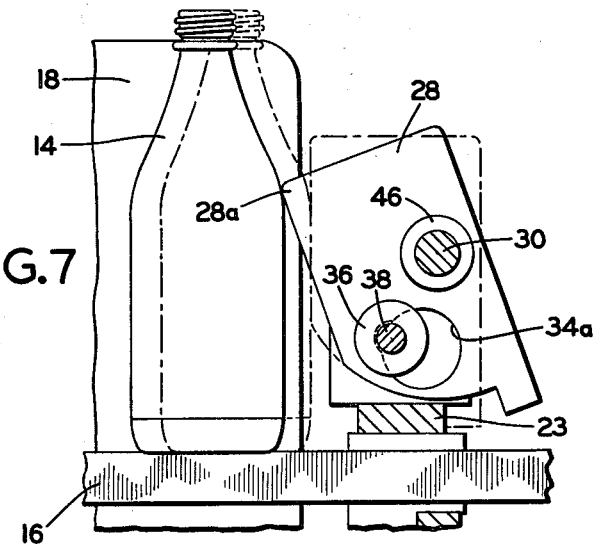

PACKING HEAD FILL SAFETY DEVICE

BACKGROUND OF INVENTION

The apparatus of the invention is particularly adapted for use with article caser or packer apparatus of the type shown in U.S. Pat. No. 3,052,071. In such apparatus, a plurality of streams of abutted articles are fed through a fixed course down to a packer grid wherein the articles are arranged in sets or groups corresponding to the arrangement of bottles or other articles to be carried in the case to be packed. After the articles or bottles are arranged in suitable groups, then they are dropped to deposit them into the carrier case for further processing.

In apparatus of this type, it is very desirable that safeguards be provided to insure that the case packer grid be properly filled with an array of articles for filling the carrier case completely. Thus, each individual row of bottles, as moved into the case packer head, normally has a stop mechanism provided therefor to indicate when such rows of articles is completely filled by the pressure of following articles in the stream of articles being fed toward the case packer head. When the individual stop member or safety device for each row of abutted articles is properly set, then the apparatus permits the case filling action by article drop or equivalent.

In the past, it is known to have pivotally positioned barrier flags as a portion of the stop member at the end of each row of articles arranged on the case packer grid and, thus, a wave form control beam, such as a sonic or light beam, can be transmitted through the stop members to obtain a control action when the individual stop members or flags for each row of abutted articles are moved to a proper release position. It also has been known to use an electrical control circuit wherein pivotal flags at the stop members are moved to non-contacting relation, for example, with an electrical conductor extending transversely of the grid head through a plurality of holes in the flags so that when each flag is moved to its proper non-contact relationship with the electrical conductor, or vice versa, then a case filling control action can be obtained. See U.S. Pat. Nos. 3,421,285 and 4,030,269.

While such apparatus, as has been proposed heretofore, has worked satisfactorily in many instances, it is always desirable to provide a more positive acting control that will have a long service life with a minimum of maintenance.

The general object of the invention is to provide a fully mechanically constructed apparatus for detecting the filling of a grid head with articles for case filling action and for providing a control function.

Another object of the invention is to provide pivotally positioned stop flags in grid filling heads safety devices for actuation from a no-load to a loaded position, and for using the loaded position to mechanically release an actuator for case filling action.

Another object of the invention is to provide a grid filling head detection mechanism, including pivotally positioned flags wherein the flags can be operable as safety detection devices in either of two positions which are 180° out of phase relationship with each other for detecting or being actuated by a small vertical height article in the grid head and/or by a larger vertically extending article in the grid head.

Yet another object of the invention is to provide, in effect, a mechanical interlock relationship between keyhole shaped apertures in pivotal safety flags in article casing apparatus, and a safety bar extending transversely of the grid head and normally held in inoperative position by the pivotally positioned safety flags in the apparatus.

The foregoing and other objects and advantages of the invention will be made more apparent as the specification proceeds.

Reference now is directed to the accompanying drawings, wherein:

FIG. 3 is a downstream end elevation of the apparatus of FIG. 1, taken on line 3—3 thereof;

FIG. 4 is a fragmentary vertical section taken on line 4—4 of FIG. 1;

FIG. 5 is a fragmentary vertical section, like FIG. 4, but with the safety flag being in its loaded or operative position;

FIG. 6 is a fragmentary vertical section on line 6—6 of FIG. 5; and

FIG. 7 is a vertical section like FIG. 4, but with the grid filling head safety mechanism being rotated through a 180° arc in a horizontal plane to be in reverse position in the filling head.

When referring to corresponding members shown in the drawings and referred to in the specification, corresponding numerals are used to facilitate comparison therebetween.

SUBJECT MATTER OF INVENTION

Figure 1:
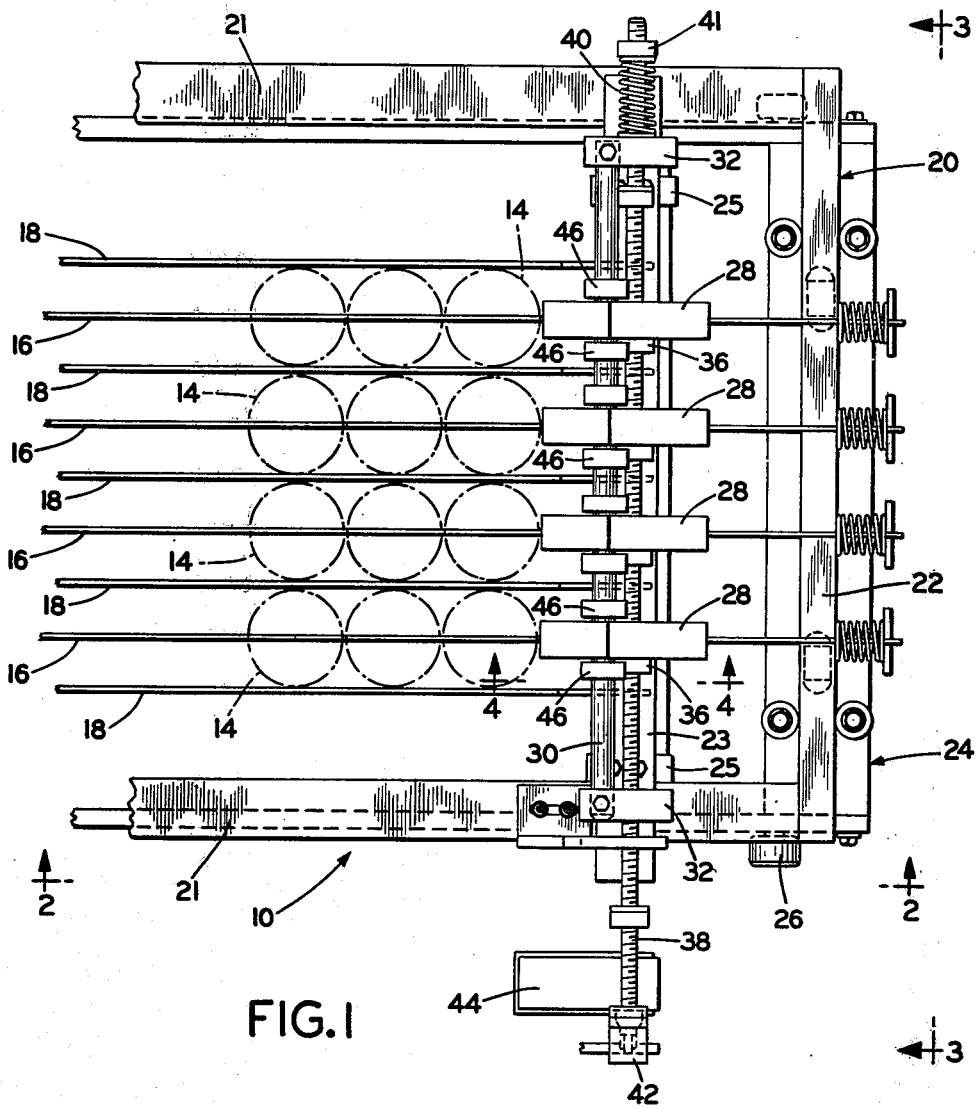
FIG. 1 is a fragmentary plan view of a grid filling head and apparatus embodying the principles of the invention.
Figure 2:
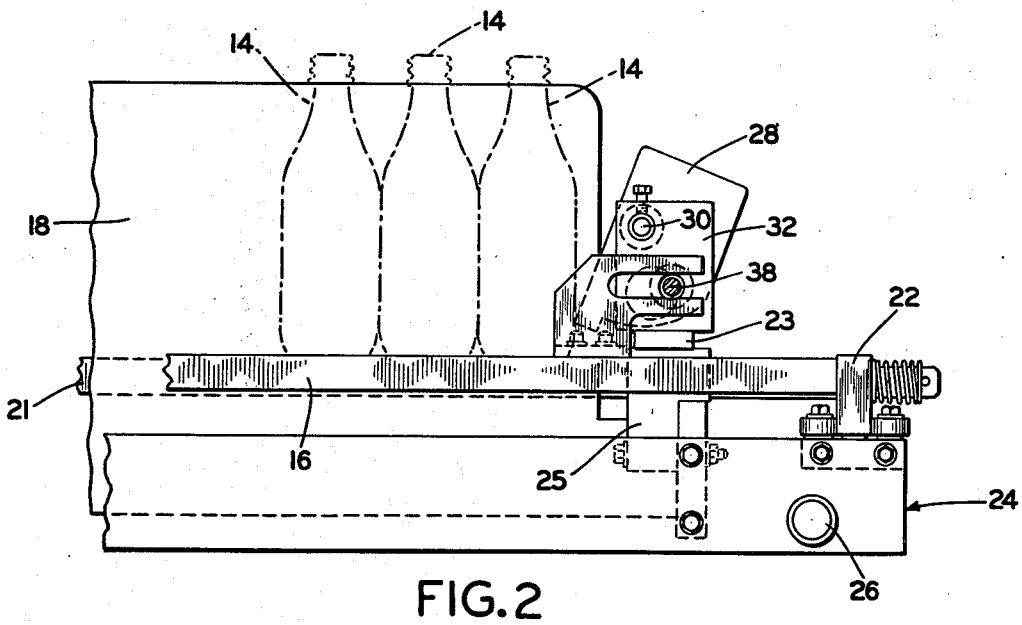
FIG. 2 is a vertical section taken on line 2—2 of FIG. 1.

The invention relates to a safety device for case packer filling heads wherein means are provided for supplying a plurality of rows of abutted articles to the case packer filling head and wherein a plurality of pivotally positioned stop members or flags are provided, each one being aligned with a row of articles being fed to the filling head so that an article moved fully into the filling head strikes the stop member to move it to an operative position from a normal inoperative safety position, each of the stop members having a keyhole shaped aperture therein that are aligned transversely of the filling head with equivalent apertures in their inoperative positions, a control bar extending transversely of the filling head and extending through the smaller sections of the apertures when the stop members are inoperative, stop collars or devices on the control bar for each of the stop members and sized to be accepted only in the larger areas of the apertures in such stop members and to align therewith only when the stop members are in their operative positions. Means are present to urge the control bar transversely of the filling head and known control means for the filling head are operatively associated with such control bar to be activated by axial movement thereof when all stop members are moved to operative positions for a case filling action.

Reference now is particularly directed to the details of the apparatus of the invention, and a case packer filling head is indicated as a whole by the numeral 10. This case packer filling head 10 is adapted for use with case packers of the type shown in U.S. Pat. No. 3,052,071, and a portion of the frame 12 for such apparatus is indicated in the drawings. The apparatus is adapted to provide a plurality of streams of abutted articles such as bottles 14 that are moved by the drive conveyor means of the apparatus to be slid into the filling head 10 on slide bars 16 extending longitudinally of the filling head. The rows of abutted bottles are maintained in alignment with each other by longitudinally directed partitions 18 as is conventional in filling heads of this type. These partitions 18 and slide bars 16 extend longitudinally of grid slide frame 20 having side bars 21, 21, and an end bar or member 22. The main grid frame 24 is positioned below the slide frame 20 and is normally positioned for a limited movement longitudinally of the apparatus as upon rollers 26 that engage suitable support portions on the main apparatus frame 12 to provide a longitudinal separating movement of the main grid frame 24 from an associated upstream portion of the apparatus 12 (not shown) when the grid is filled with articles and is being prepared for article drop action. A pivotally positioned stop member or flag 28 is provided for each of the rows of bottles 14 and it is pivotally carried by a support shaft 30 extending transversely of the main grid frame and mounted on end brackets 32. Such brackets 32 are secured to a cross bar 23 forming an upper portion of the main grid frame 23 and attached thereto by connector blocks 25.

These stop members 28 have normal inoperative positions, as shown in FIG. 4, and at such time, a transversely extending hole or aperture 34, which may be of keyhole shape in vertical section, is out of alignment with a stop member, such as a stop collar 36 on a control shaft 38. A plurality of these stop collars are provided at transversely spaced portions of the mounting shaft 38, which may be threaded, and the collars 36 thereon are suitably tapped whereby their positions on the mounting shaft 38 can be varied, as desired. Normally, one of these stop collars 36 is positioned immediately laterally adjacent corresponding sides of each of the stop members 28 when in their inoperative positions. The stop collar is of such shape and size as to be received in a larger diameter portion 34*a* of the keyhole shaped aperture 34 and the stop members are adapted to be moved or pivoted downstream through a short arc to operative or released positions when an article strikes them. This operative position is shown in FIG. 5 and at that time, the stop collar 36 aligns with the larger portion of the aperture 34 and, when all of the flags 28 have been moved to their operative or vertical positions of FIG. 5, then the control shaft 38 can be moved axially. The control shaft 38 is biased axially away from the right side bracket 32 in the apparatus as shown in FIG. 3 by a spring means 40 compressed between such bracket and a collar 41 on the shaft 38.

FIG. 3 of the drawings best shows that an end portion of the control shaft 38 has an actuator finger or arm 42 thereon and this arm is positioned immediately adjacent a control means such as a limit switch or the like 44. The action of the control apparatus is such that, when the control shaft 38 has been mechanically released and moved to its operative position, the switch 44 is actuated and any suitable control means operatively connected thereto will be actuated to move the slide grid frame 20 laterally of the main grid frame 24 and cause resultant drop of the articles positioned on the grid frame. Such drop is conventionally produced by the slide bars 16 being moved with the slide grid frame over into vertical alignment with the partitions 18 retained in position by the main grid frame 24.

FIG. 6 shows how a stop collar 36 is received within a portion of the aperture 34 to move axially therewith. The drawing also shows how positioning collars 46 are usually adjustably engaged with the support shaft 30 to maintain these stop members or flags in a fixed vertical plane and prevent lateral movement thereof when in use.

It is seen from FIG. 4 that the shaft 30 engages the flags or stop members in such a way that gravity positions the lower ends of the flags to extend in an upstream direction to be contacted by the article moving into the apparatus. A stop finger or lug 48 on the stop members will engage a support bar or auxiliary cross bar 23, forming a part of the stop member assembly and extending transversely of the grid slide frame to terminate pivotal movement of the stop members produced by a bottle moved completely into the grid frame.

It should be noted that an assembly of the end brackets 32 and support shaft 30 can be separated from the remainder of the grid frame in the apparatus and this support shaft and associated means then can be rotated 180° in a horizontal plane and be secured to the main frame to position the stop members in the manner shown in FIG. 7. At that time, upstream upper end portions 28*a* of the stop members protrude upstream in the apparatus to provide a contact area for the stop flag that is positioned at a much higher vertical location than the protruding lower end of the stop flag when the apparatus is in the position shown in FIG. 4. Accordingly, it will take a taller vertical article to contact the stop flags and move them to operative or released positions. While the size of the articles 14 shown in FIGS. 4 and 7 of the drawings are the same, it will be realized that for different shapes and/or sizes of bottles, it could be very helpful to use the FIG. 7 assembly. Or, if it is particularly important that the apparatus not be actuated by a bottle positioned on its side in the apparatus, then the construction shown in FIG. 7 should be used. It is normal to use the apparatus with the safety flag shown in the position of FIG. 4.

It will be seen that the stop members 28 protrude both upstream and downstream from their mounting means 30 to achieve the results and functions described hereinbefore.

From the foregoing, it will be seen that the stop members 28 have inoperative normal safety positions in the apparatus. But when an article moved onto the grid strikes such stop member, it is moved to its operative or released position. Hence, when all of the abutted rows of articles fed to the filling head 10 have so actuated the stop members in association therewith, then the control bar or shaft 38 and associated means will be moved laterally of the filling head and a control action can be obtained. But, the filling of the grid head has been insured by the apparatus. The apparatus is adjustable for different sizes and/or arrays of articles to be encased by adjustment of the stop members laterally of the shaft 30 and of the collars 36 on the control shaft 38.

The apparatus of the invention is quite positive in action, it is made from all mechanical components and it will provide a very long service life with a minimum of maintenance. Hence, it is believed that the objects of the invention have been achieved.

While two complete embodiments of the invention have been disclosed herein, it will be appreciated that modification of these particular embodiments of the invention may be resorted to without departing from the scope of the invention.

What is claimed is:

1. A safety device for a case packer filling head wherein a plurality of rows of abutted articles are fed into the filling head, an individual pivotally positioned stop member is provided for each of the rows of articles being fed to the filling head, and wherein an article moved completely into the filling head strikes a stop member to move it to an operative position but with the stop member having a normally inoperative safety position, the improvement comprising a control bar extending transversely of the filling head and extending through a non-circular aperture provided in each stop member, means urging said control bar axially, and a stop collar on the control bar for each of the stop members and sized complementary to a portion of the aperture provided in said stop member to be movable into such aperture only when the stop member is moved to an operative position at which time when all stop members are so operatively positioned, the control bar is moved axially for a control action on the filling head and articles positioned therein.

2. In a case packer filling head safety device as in claim 1, the provision of a filling head frame, a transversely extending shaft on said head frame engaging and pivotally positioning said stop members for pivotal movement thereon, and wherein said stop members are so sized and arranged that they are positioned to depend from said support shaft and to protrude upstream therefrom by a portion below said support shaft and when said support shaft and the stop members thereon are turned through a 180° arc in a horizontal plane, then said support members depend from said support shaft so as to protrude upstream from said support shaft in a portion vertically above said support shaft whereby said stop members can be struck by articles of different heights to be actuated thereby dependent upon the relative position of said stop members to said support shaft and to the filling head support frame.

3. In case packer filling head safety devices as in claim 1 wherein a filling head is movably positioned in the apparatus and it receives the streams of abutted articles, the filling head including a frame, and means positioned on said frame including said stop members and said transversely extending shaft.

4. A case packer filling head safety device comprising a plurality of pivotally positioned stop members each one of which is aligned with a row of articles being fed to a filling head, an article moved fully into the filling head striking a stop member to move it to an operative position, said stop members having normal inoperative safety positions, each said stop member having a keyhole shaped aperture therein, which apertures in the stop members are aligned transversely of the filling head in their operative and inoperative positions and each aperture has a smaller section and a larger section, a control bar extending transversely of the filling head and extending through the smaller sections of said apertures when said stop members are inoperative, stop collars on said control bar sized to be accepted only in the larger sections of said apertures, and to align therewith only with said stop members in their operative positions, means urging said control bar axially, and control means for the filling head activated by axial movement of said control bar which occurs only when all stop members are moved to operative positions.

5. In a case packer filling head safety device as in claim 4, the provision of a filling head frame including slide bars over which articles move into said frame, a transversely extending shaft on said head frame engaging and positioning said stop members for pivotal movement thereon, said slide bars being at lower vertical height positions in the case packer than said stop members, said stop members being so sized and arranged that they are positioned to depend from said support shaft and to protrude upstream therefrom by a portion below said support shaft and when said support shaft and the stop members thereon are turned through a 180° arc in a horizontal plane, then said support members depend from said support shaft so as to protrude upstream from said support shaft in a portion vertically above said support shaft whereby said stop members can be struck by articles of different heights to be actuated thereby dependent upon the relative position of said stop members to said support shaft and to said filling head frame.

6. In a case packer filling head safety device as in claim 4 where a main grid frame is operatively associated with article feed means of the case packer, a slide grid frame is positioned on said main grid frame for controlled lateral movement, and said stop members are positioned on said main frame.

* * * * *